US005139267A

United States Patent [19]

Trevisan

[11] Patent Number: 5,139,267

[45] Date of Patent: Aug. 18, 1992

[54] METHOD OF PLAYING A RACING GAME

[76] Inventor: Richard S. Trevisan, 3509 Kensington St., Stuart, Fla. 34997

[21] Appl. No.: 669,029

[22] Filed: Mar. 13, 1991

[51] Int. Cl.[5] ..... A63F 3/00

[52] U.S. Cl. ..... 273/246; 273/431

[58] Field of Search ..... 273/246, 249, 248, 429–932

[56] References Cited

U.S. PATENT DOCUMENTS

| | | | |
|---|---|---|---|
| D. 123,508 | 11/1940 | Moore | 273/248 |
| 4,264,076 | 4/1981 | Duncan | 273/246 |
| 4,714,255 | 12/1987 | Henry et al. | 273/249 |
| 4,854,594 | 8/1989 | Eaton | 273/249 |

FOREIGN PATENT DOCUMENTS

| | | | |
|---|---|---|---|
| 1417646 | 12/1975 | United Kingdom | 273/246 |

*Primary Examiner*—Benjamin Layno

*Attorney, Agent, or Firm*—Nies, Kurz, Bergert & Tamburro

[57] ABSTRACT

A racing game utilizing a game board which simulates an auto race course is disclosed. In one embodiment, the invention relates to a board game which provides features similar to a NASCAR auto race. Each player receives a racing car game piece and a crew chip. Upon spinning the dial during the player's turn, the player places his crew chip on the board space corresponding to the spin number and then takes a card from either of two stacks depending on the color of the space occupied by the crew chip. If the player answers correctly the question on the card, he moves his game piece to the space occupied by the crew chip and removes the crew chip. If he answers incorrectly, the crew chip is withdrawn and the game piece remains in the position occupied at the beginning of the turn. Play continues as the game pieces are moved around the board with bonus points and penalties being received depending on the space occupied by the player during the course of the game.

14 Claims, 5 Drawing Sheets

FIG. 4

PERSONAL

NAME THE HOME TOWN OF KYLE PETTY.

-*RANDLEMAN, N.C.*

HISTORY

TRUE or FALSE- THE WINSTON 500 WAS EARLIER THE ALABAMA 500.

-*TRUE*

TRACKS

WHAT IS THE LENGTH OF DAYTONA SPEEDWAY?

-*2.5 MILES*

MECHANICAL

WHAT DOES THE WHITE FLAG MEAN?

-*1 LAP TO GO*

FIG. 5

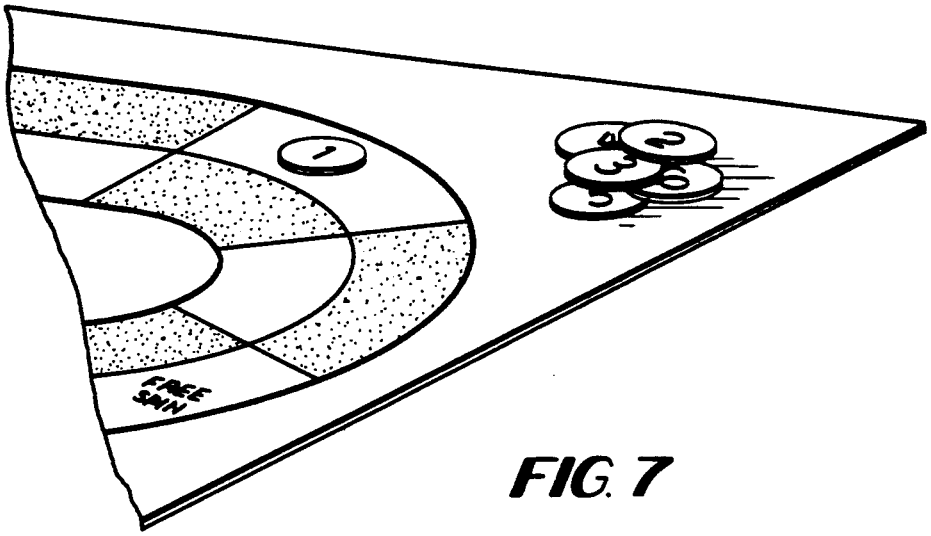
FIG. 7
FIG. 8
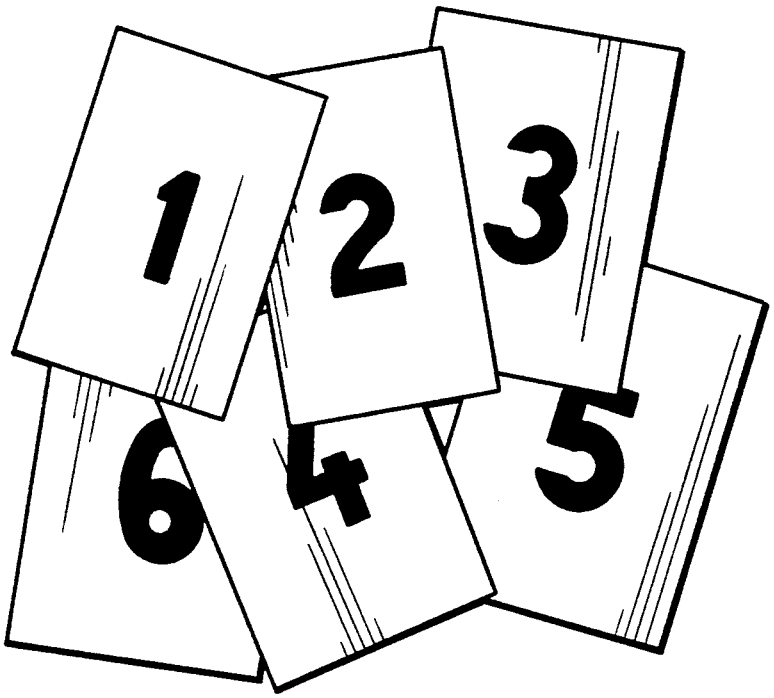

METHOD OF PLAYING A RACING GAME

BACKGROUND AND SUMMARY OF THE INVENTION

The present invention relates to a method of playing a racing game utilizing a game board which simulates an auto race course. More particularly, the present invention relates to a racing board game having a construction and features which simulate an auto race such as a NASCAR auto race.

Previous games which simulate an automobile race are described in the following U.S. Pat. Nos.: 1,148,737 to Atkins; 1,523,242 to Bain; 2,577,961 to Graves; 3,044,779 to Hvizdash; 3,738,659 to Partridge; 4,323,249 to Brady; and 4,624,463 to Glennon.

Other racing games are described in British Patents Nos. 1,417,646; 1,469,067; and 2,021,959.

By the present invention, there is provided a simulated auto racing game for amusement which includes playing pieces in the form of cars which are movable in response to chance determined events around a game board which simulates an auto race course. The game of the present invention provides features similar to an auto race such as a NASCAR auto race.

In one embodiment, the present invention relates to a board game of NASCAR questions. It is a game to better inform NASCAR racing fans about their sport. NASCAR racing fans are loyal to their sport and are very knowledgeable about facts that deal with racing. They often quiz each other about facts or events related to the 29 NASCAR races which take place over a period of ten months during each racing year. The present invention will thus fill a need and is easy to play. The game has many interesting facts that all race fans will enjoy. This game will be played with real race situations to simulate the thrills of NASCAR racing by playing a series of races with a point system that is intended to reveal the player who is most knowledgeable about NASCAR racing.

In one embodiment, the game of the present invention employs two different tracks. On one side of the game board is a track having a tri-oval shape known as a Super Speedway and the other side of the board has a small circular track known as a Short Track. The same cards and pieces will be used for both tracks and the players will make a choice when the game begins as to which track should be played.

The main object of the game of the present invention is to spin the dial on the game board and hope for a high spin, then answer all the questions correctly and be the first player to cross the finish line on the last lap for each of five races and, in the process, to collect the most points and bonus points so as to be declared the champion.

BRIEF DESCRIPTION OF THE DRAWINGS

FIG. 4 is a plan view of an "A" game card employed in the present invention.

FIG. 5 is a plan view of a "B" game card employed in the present invention.

FIG. 7 is a perspective view showing crew chip pieces employed in playing the game of the present invention.

FIG. 8 is a perspective view showing cards employed in determining pole and pit position for the present game invention.

DESCRIPTION OF THE PREFERRED EMBODIMENTS

With reference to the above drawings, the following racing game rules will apply.

The racing game is for two to six players, ages 10 and above. Whenever reference is made herein to the word "his", such reference is intended to include "his or her", as the game is for use and enjoyment by both male and female players.

A player can score by answering questions and advancing around the track to collect a lap or chip. The lap chips to which reference is made herein are of the approximate size and shape of poker chips. In one embodiment, the winner of five laps or chips will be declared the overall winner of the race. The commissioner keeps track of laps completed by each player.

Figure 3:
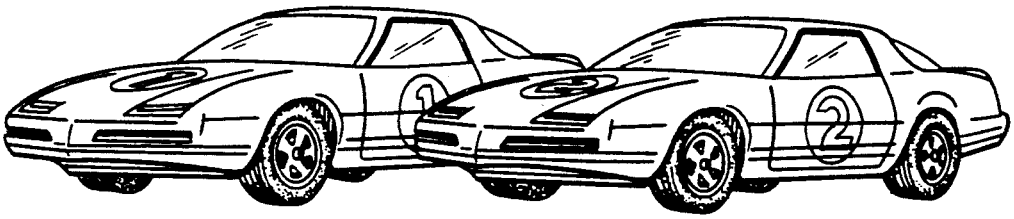
FIG. 3 is a perspective view of a pair of racing car game pieces of the present invention.
Figure 6:
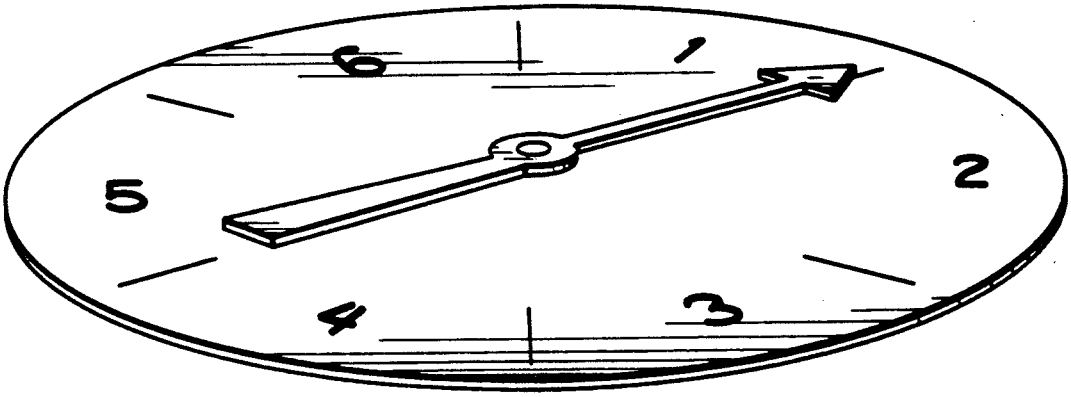
FIG. 6 is a perspective view of a dial or spinner employed in the present invention.

The game is started by deciding how many players will play the game, then each player picks the racing car game piece of his choice, such as those shown in FIG. 3 which represent NASCAR race cars. Each player also receives one chip having the same number as the car, as shown in FIG. 7. This chip is called the "crew chip".

The next step is for each player to draw a card for pole position. These cards are shown in FIG. 8 and may be of any convenient size such as the approximate size and shape of regular playing cards. The player that wins the pole position becomes the first one in line to start the race, and the first player to roll, and thus the first player to attempt to answer the first question.

The player who draws a one card or the lowest card wins the pole position. The player who draws a two or the second lowest card starts second, and so on down the line. There are a total of six pole cards if six players are playing.

Figure 1:
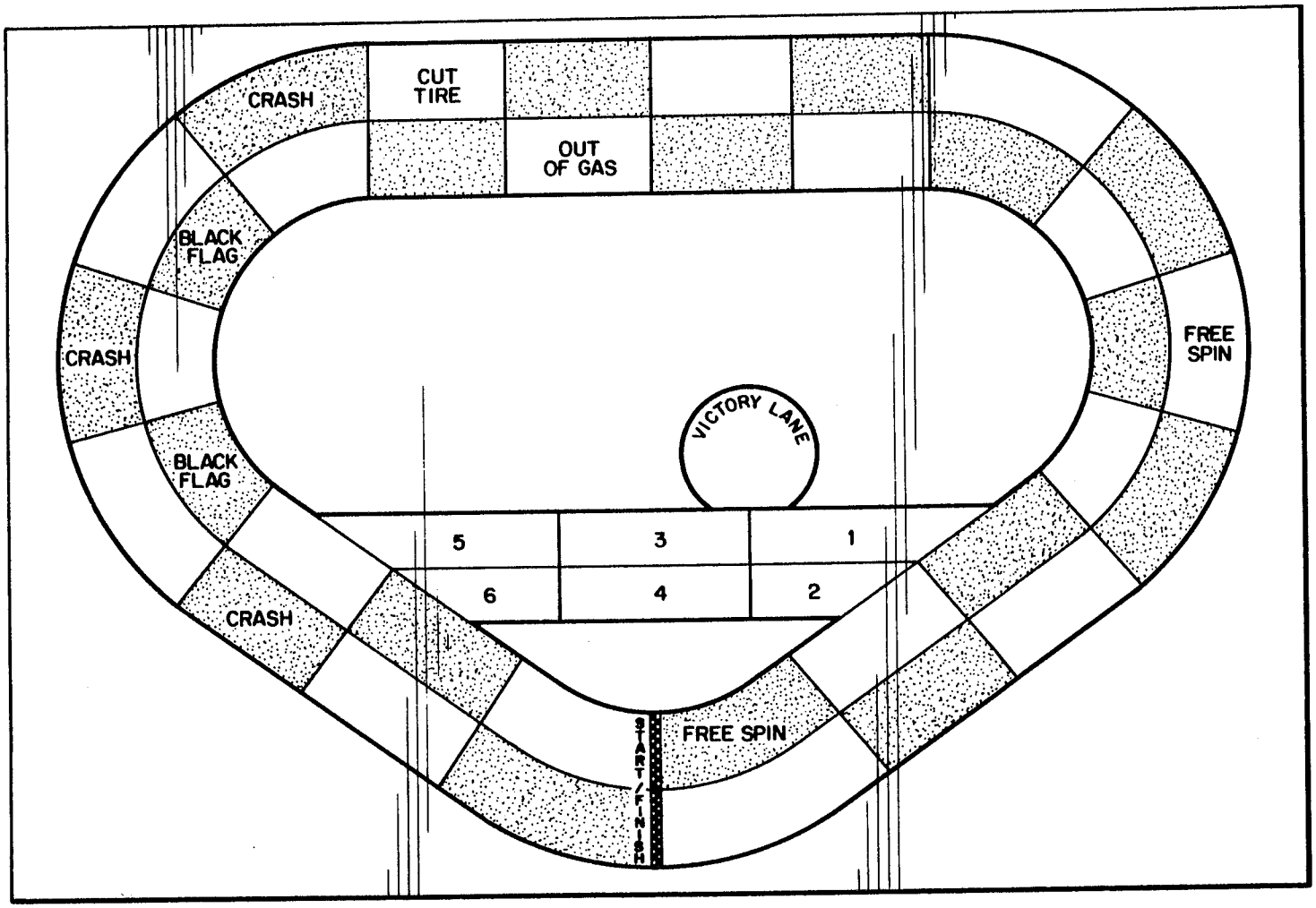
FIG. 1 is a top plan view of a racing game board of the present invention.
Figure 2:
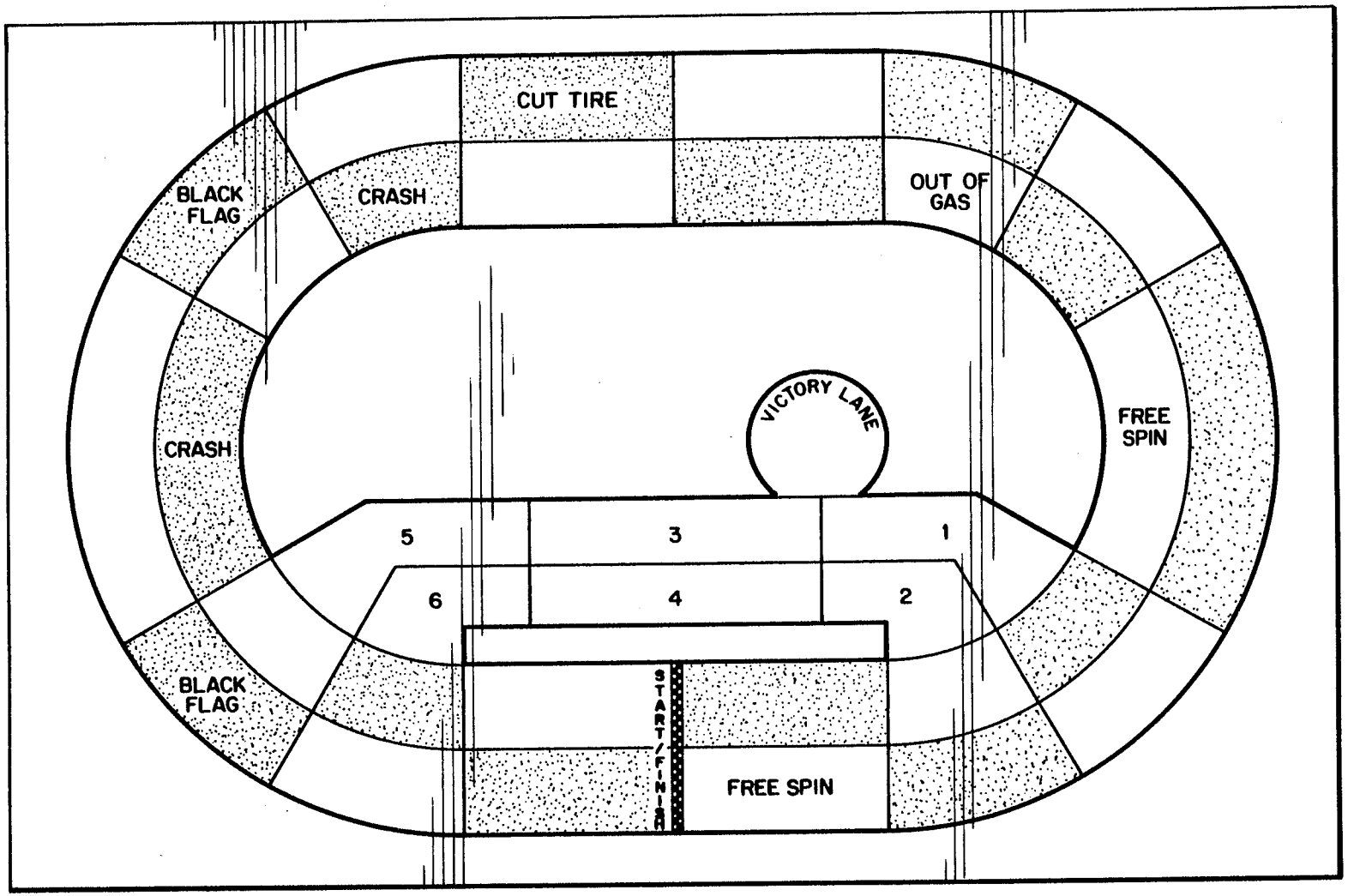
FIG. 2 is a top plan view of an alternative embodiment of the racing game board of the present invention.

To play the game, a player spins the dial, counts the spaces in a counter clockwise direction from the start/-finish line, then selects a lane. As shown in FIGS. 1 and 2, the lane selected may be the inside or outside lane. The track spaces which are shaded represent "A" colored spaces while the unshaded track spaces represent "B" colored spaces. These colored spaces are arbitrarily chosen for the track and could be reversed. The player places his crew chip on the space as designated by the number on the dial in the selected color or lane, then picks up the colored card of the same colored space on which the crew chip rests. The player next selects a category on the card and attempts to answer the question. If a player answers the question correctly, the player then moves his car to that space, and picks up his crew chip. If the player cannot answer the question correctly, the player's car does not move, and the player picks up his crew chip. If a player's crew chip was on a penalty space, he takes the penalty and then picks up the chip.

If the player rolls and lands on a space having one lane already occupied, that player automatically has to take the opposite lane and attempt to answer that colored question. If the player rolls and lands on a space having both lanes already occupied by two cars, that player spins again, until the spinner shows a space which is available.

The crew chip is used after the player spins the spinner and counts the spaces. He then places the crew chip on the space of his choice. Upon answering correctly, the player advances the car to the space and picks up the crew chip. Upon answering incorrectly, the player picks up the chip but does not move the car. If landed on a penalty space, the player receives the penalty.

As shown in FIGS. 1 and 2, the tracks have pit positions such as those numbered 1 through 6. A player's pit position is determined by the pole position. Example: the player on the pole who had card No. 1 lowest number will be assigned pit position No. 1. The second starting position will be assigned pit position No. 2 and so on.

If a player rolls and lands on a penalty space, failure to answer the question will result in a penalty. If a player lands on a penalty space and answers correctly, the player then disregards that penalty.

When a player lands on Crash and cannot answer the question, the penalty is to return counter clockwise to the assigned pit without collecting a lap or chip and lose two turns or spins of the spinner.

When a player lands on Out of Gas and cannot answer the question, the penalty is to return clockwise back two spaces or to the next available space behind that space.

When a player lands on Black Flag and cannot answer the question, the penalty is to return counter clockwise to the assigned pit and without collecting a lap and chip, but lose one spin of the spinner.

When a player lands on Cut Tire and cannot answer the question, the penalty is to return clockwise back two spaces or the next availale space behind that space. When backspacing clockwise, all players disregard all bonus and penalty spaces, laps and chips. The player who backspaces across the start/finish line will not receive a lap or chip as he recrosses the start/finish line on the next spin.

As a bonus, when a player lands on Free Spin and answers correctly, the player is allowed to spin again.

The "A" cards, as shown in FIG. 4, include both personal and history questions. Personal questions include questions about drivers, teams, and owners. History questions include questions about historical personnel, tracks, and general questions.

The "B" cards, as shown in FIG. 5, include mechanical and track questions. Mechanical questions include questions about cars, tools, sponsors, and rules. Track questions include questions about size, speed, and general track statistics and location.

Before every race a commissioner will be selected to read all questions and make all rulings. When it comes time for the commissioner's question, he will select a player to read the question to the commissioner.

All questions must be answered within the time limit set by the commissioner, or within a time limit such as five seconds as agreed beforehand.

If the players wish to play a series of several races, players will be awarded points for finishing each race. To finish one race in:

First place, player receives 100 points;
Second place, player receives 95 points;
Third place, player receives 90 points;
Fourth place, player receives 85 points;
Fifth place, player receives 80 points;
Sixth place, player receives 75 points;
Seventh place, player receives 70 points;
Eighth place, player receives 65 points.

Players also receive bonus points for leading a race, including two points for leading one lap of the race, and two additional points for leading the most laps of one race.

New questions cards may be made up every year to keep the game interesting and up-to-date. Approximately 2,000 to 5,000 questions may thus be made available for playing the game.

In another embodiment of the invention, a 1-900 telephone number may be employed in a promotional event to allow persons to call in and answer questions. If a certain number of questions are answered correctly, the telephone game player would be eligible for prizes such as race tickets, board games or cash prizes.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed and desired to be secured by Letters Patent is:

1. A method for playing a game on a board having defined thereon a racing course with two lanes and with each lane divided into plural similar course units, said playing board having game directing instructions located on some of the course units, and having a plurality of pit positions, and with said course units including units of two different colors, and including a plurality of cards in two groups with each card in a group having an obverse side of a similar color and with various game directing instructions in the form of questions on the faces thereof, with each group of colored cards being of a similar color to the color of one of the course units, the cards to be used to direct game play in response to a predetermined condition of game play, wherein the method of play comprises:

(a) placing each player's game piece at the starting line in a pole position determined by drawing a card for starting position;

(b) upon each player taking a turn at playing the game, first operating a spinner for determining player movement;

(c) placing a crew chip piece on a course unit in one of the two lanes determined by the number indicated on the spinner;

(d) answering a question on one of the cards of a color corresponding to the color of the course unit temporarily occupied by the crew chip;

(e) upon correctly answering the question, each player placing that player's game piece on the course unit temporarily occupied by the player's crew chip and removing said crew chip;

(f) upon incorrectly answering the question, each player removing said crew chip and with that player's game piece remaining in its position occupied prior to operating the spinner, unless the course unit temporarily occupied by the player's crew chip had game directing instructions located thereon indicating a penalty which delays proceeding around the racing course, in which event the player's game piece is moved in accordance with the penalty instructions; and (g) repeating steps (b) through (f) by each player in turn until one player reaches the end of the racing course.

2. The method of claim 1 wherein, in carrying out step (c), in the event that one of the two course units as determined by the number indicated on the spinner is occupied by another player, a player is required to place that player's crew chip on the course unit which is not occupied and to answer a question from the group of cards having a color corresponding to that of the unoccupied course unit.

3. The method of claim 1 wherein, in carrying out step (c), in the event that both of the two course units as determined by the number indicated on the spinner are occupied by other players, a player is required to spin again until the spinner shows a course unit which is not occupied.

4. The method of claim 1 wherein said game board has a racing course shown on each of two sides of said game board and including the further initial step of selecting the side of the board to be played.

5. The method of claim 1 wherein each card has a question in each of two categories of subject matter.

6. The method of claim 1, including the additional step for each player of placing that player's crew chip in a designated pit position when said crew chip is not occupying a course unit on said game board.

7. The method of claim 1, including the step of designating one player as game commissioner to read the questions on the cards and determine the correctness of the answers to said questions.

8. The method of claim 1 wherein the racing course shown on the game board represents one lap and wherein the player who wins the race must complete a plurality of laps.

9. The method of claim 8 wherein bonus points are awarded to each player who leads a lap and first place in the race is determined by the player with the highest total points.

10. The method of claim 1 wherein one group of cards contains indicia relating to personal information and historical information concerning auto racing, and with the other group of cards containing indicia relating to race track information and mechanical information concerning auto racing.

11. The method of claim 1 wherein course units of two different colors are located in side-by-side relation throughout the racing course.

12. The method of claim 1 wherein each card has at least one question related to trivia concerning NASCAR racing.

13. The method of claim 1 wherein said playing board and said game directing instructions on the cards simulate a NASCAR auto race.

14. The method of claim 1 wherein said game pieces simulate NASCAR race cars.

* * * * *